US006196396B1

(12) United States Patent
Bennett

(10) Patent No.: US 6,196,396 B1
(45) Date of Patent: Mar. 6, 2001

(54) APPAREL ACCESSORIES RACK

(76) Inventor: Erith Lestine Bennett, 13016 Ingleside Dr., Beltsville, MD (US) 20705

( * ) Notice: Subject to any disclaimer, the term of this patent is extended or adjusted under 35 U.S.C. 154(b) by 0 days.

(21) Appl. No.: 09/410,076

(22) Filed: Oct. 10, 1999

(51) Int. Cl.[7] ..... A47F 7/00

(52) U.S. Cl. ..... 211/85.3; 211/113; 211/85.2; 223/87; 223/DIG. 1

(58) Field of Search ..... 211/85.2, 85.3, 211/113; 223/85, 87, 92, 88, DIG. 1

(56) References Cited

U.S. PATENT DOCUMENTS

D. 191,647 * 10/1961 Seeger .
D. 323,748 * 2/1992 LaCroix et al. .
2,077,316 * 4/1937 Geib .
2,492,226 * 12/1949 Kohl et al. .
3,081,881 * 3/1963 Seeger .
3,783,995 * 1/1974 Tobin ..... 211/113 X
3,945,500 * 3/1976 Meckstroth ..... 211/113
4,966,287 * 10/1990 Snyder ..... 211/113 X
5,295,587 * 3/1994 Downes et al. ..... 211/118 X
5,934,524 * 8/1999 Gray ..... 223/DIG. 1

* cited by examiner

*Primary Examiner*—Robert W. Gibson, Jr.
(74) *Attorney, Agent, or Firm*—Robert Halper

(57) ABSTRACT

A shaped figure designed for suspending apparel accessories such as ties, belts, scarfs and the like wherein the figure comprises a flat plate of injection molded plastic having cutouts configured to form a series of downwardly inclined sets of steps, wherein a lower set is parallel to an upper set. The shaped figure is coated with fluorescent paint.

9 Claims, 2 Drawing Sheets

1
2
2a
3
4
5
6
7
7
8
10
11
12

APPAREL ACCESSORIES RACK

FIELD OF INVENTION

This invention pertains to racks or hangers for clothing accessories such as ties, belts and scarfs.

BACKGROUND OF THE INVENTION

The art is replete with racks of various designs as exemplified by the patents enumerated below, subdivided into Design and Utility patents.

D 167,986 depicts a tiehanger using the basic frame of a clothes hanger wherein the transverse rod that normally supports a garment is extended to two outward inclined legs. Along the inclined legs, adjacent, arcuate pockets are formed on each leg at several levels. Each pocket supports a tie.

D 211,795 shows a tierack with a hook at its upper end for attachment to a shaft. Suspended from the hook are a plurality of aligned, zig-zag surfaces, each surface used for mounting ties at the bottom end of the aforesaid zigzag surfaces. At the bottom of the device there are a pair of parallel hooks perpendicular to the hook above the zig-zag surfaces.

D 298,782 illustrates a triangular like shaped tiehanger with a vertical member bisecting its base and extending upwardly to end in a hook. At equally proportioned levels of each side is a rod supported in grooves in the triangular like member. The rods are positioned in an alternate arrangement with respect to each side.

D 394,557 is another clothes hanger style tierack, wherein the triangular member depending from the hook is made of a solid member of substantial thickness having a plurality of rods projecting perpendicularly outward from both sides of the solid member. The rods are equally spaced each from other at two levels. The lower level rods are interspersed between the upper level rods, and the rods on each side of the thickened member are in different planes.

U.S. Pat. No. 2,401,835 teaches a delivery rack for neckties or similar apparel. A wired hook member is secured to a trapezoidal shaped thin plate having about five shaped openings for insertion and support of the ties. The shaped openings are arranged so that there is a central opening, spaced evenly between two upper laterally spaced openings and two lower laterally spaced openings.

U.S. Pat. No. 3,783,995 shows a tie rack using a rectangular single piece injection molded flat plastic body with a hook at its upper end. The body is reenforced by a thickened bead at its sides and upper end that terminates in a hook. A central portion between the bead ends has a plurality of transverse, vertically spaced openings in its upper region. In each of the openings is a hinged flap portion so that it can be received therein and held in place by the hinged flaps.

U.S. Pat. No. 3,887,079 shows a triangularly shaped multipurpose clothes hanger having attached to its apices an oppositely oriented triangular member. The opposite triangular member has a plurality of spaced arcuate surfaces along the inlined legs of the triangular member for mounting a number of secondary clothes hangers. This arrangement is suitable in a confined space of a small closet.

U.S. Pat. No. 3,938,667 is a combination tierack that supports untied and pretied neckties. A rectangular plate is telescopically received in C-shaped end brackets with fasteners passing through the member and bracket for attaching the rack to a vertical support surface. The rack has sockets from which posts extend, and on which neckties can be draped over. Wire loops extend between the posts. The loops have ends that are received in the sockets, and are spaced between the posts to support pretied neckties.

U.S. Pat. No. 3,951,270 depicts a tierack for preknotted neckties. The rack includes a plurality of flat wire frames supported in a horizontal row. The frames are spaced apart so as to form vertical receiving slots on both sides of the assembly. Stops are provided for supporting the lowermost tie in each receiving slot. The ties are suspended from a centered hook which is swivelly mounted.

U.S. Pat. No. 4,059,191 describes a tie rack for conventional neck ties and pretied ties, wherein a vertical leg of a flange is secured to a support member. The horizontal leg comprises a plurality of first and second slots, the second slots being separated from the first slots and having wider spacing to support knotted ties. The untied tie is looped through the adjacent first slots. Instead of using a right angles flange, a hook can extend from an intermediate vertical member and slots as described above can be fashioned on opposite horizontal members.

Accordingly it is an object of this invention to produce a simple, inexpensive structure wherein all functions are carried out by one, integrated unit.

It is a further object of this invention to design a rack or hanger which can accommodate over two dozen apparel items,.all of which are easily accessible.

It is still an object of this invention to produce a product which can be suspended from a closet pole or alternatively fastened to a structure like a closet door without requiring additional accessories.

It is also an object of this invention to produce a rack or hanger which is attractive and can easily be identified in a dimly lit closet.

SUMMARY OF THE INVENTION

The rack of the present invention is a shaped structure capable of supporting a plurality of unknotted neckties or other apparel accessories. The rack can be suspended from a closet rod or the rack can be mounted on a structure such as a closet door. The rack is made from a flat, injection molded, thermosetting plastic such as a polyester. The supports for the apparel accessories are arranged in stepped fashion configured from cutouts in the plastic. The steps are symmetrically arranged on each side of the shaped structure, wherein there are at least two rows of steps spaced from each other. With the exception of U.S. Pat. '270, many more apparel accessories can be stored in the present device; moreover, U.S. Pat. '270 is for preknotted ties, which is not the usual mode of manufacture in today's market. The rack is also coated with a fluorescent paint so that it is conspicuous in a dimly lit area from amongst a multitude of clothes hangers.

DETAILED DESCRIPTION OF THE INVENTION

Figures 1, 2, 3, 4:
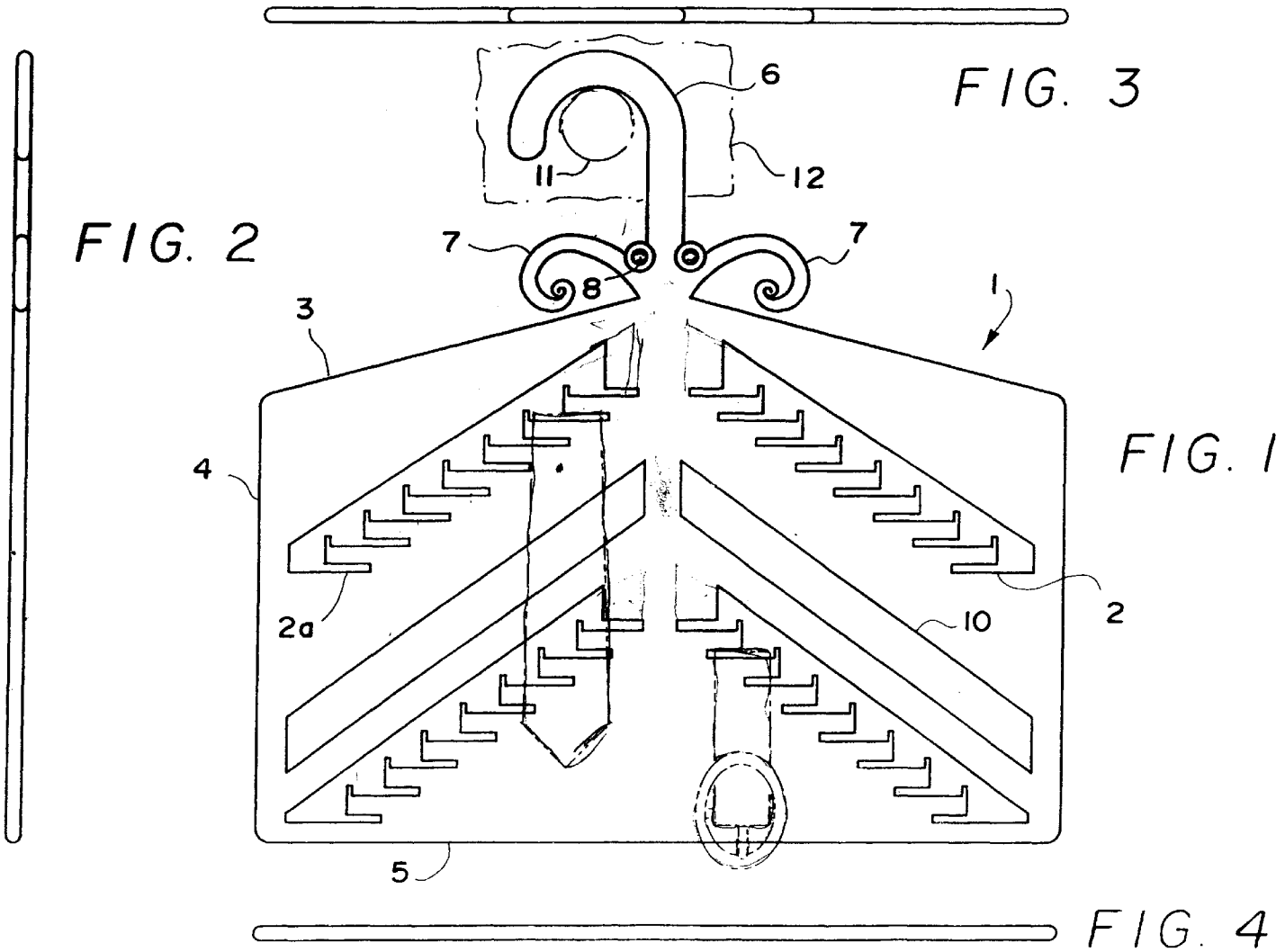
FIG. 1 is a front elevation of the invention.
FIG. 2 is a left end view of the invention.
FIG. 3 is a top plan view.
FIG. 4 is a bottom plan view.

FIG. 1 shows a rack 1 made of injection molded thermosetting plastic, and shaped somewhat like a coat hanger except that It is much longer. It is formed from a flat plate having cut outs configured with a plurality of steps 2. Starting from the top there are two downwardly divergent inclined sides 3 intersect a pair of vertical sides 4. The bottom of each vertical side intersects a horizontal base 5 to complete the structure. Integral and intermediate the two divergent sides a hook shaped member 6 extends upwardly therefrom. Extending outwardly from the hook shaped member and adjacent the divergent sides are two aligned curved members 7. These curved members terminate in a spiral shape. Between the origin of the hooked member and the origin of the curved member there are ringlets 8. Through the ringlets fasteners 8*a* are inserted and fixed in a closet structure 12. The use of ringlets with fasteners is an alternative way of suspending the rack instead of using the hook member supported on a pole 11. Within this shaped figure are two aligned cutouts configured to form a series of steps 2 as aforementioned. With respect to the pair of vertical sides the horizontal legs 2*a* of the steps are spaced inwardly and are perpendicular thereto. The steps are symmetrical and like sides 3 are divergent although not parallel to the divergent sides; however, if so desired, such a modification to design the steps to be parallel to the divergent sides is contemplated. Below and parallel to the aforementioned steps is another set of steps 2 having the same geometrical structure and the same alignment as well as the same number of steps Intermerdiate the upper and lower sets of steps are a pair of elongate cutouts 10. These cutouts diverge in the same manner as the cutouts for the steps and are parallel thereto The aforementioned main hook can suspend the rack from a rod 11 that is used to suspend a number of clothes hangers, or alternatively the rack can be supported by fasteners 12 that pass through the holes in the spirals of the curved members.

In use one apparel accessory is looped over each of the horizontal legs 2*a* of the steps, the vertical leg 2*b* acting as a backup to prevent the tie from falling off the rack. When one opens the closet, the rack can be easily spotted because of its fluorescence.

Figure 5:
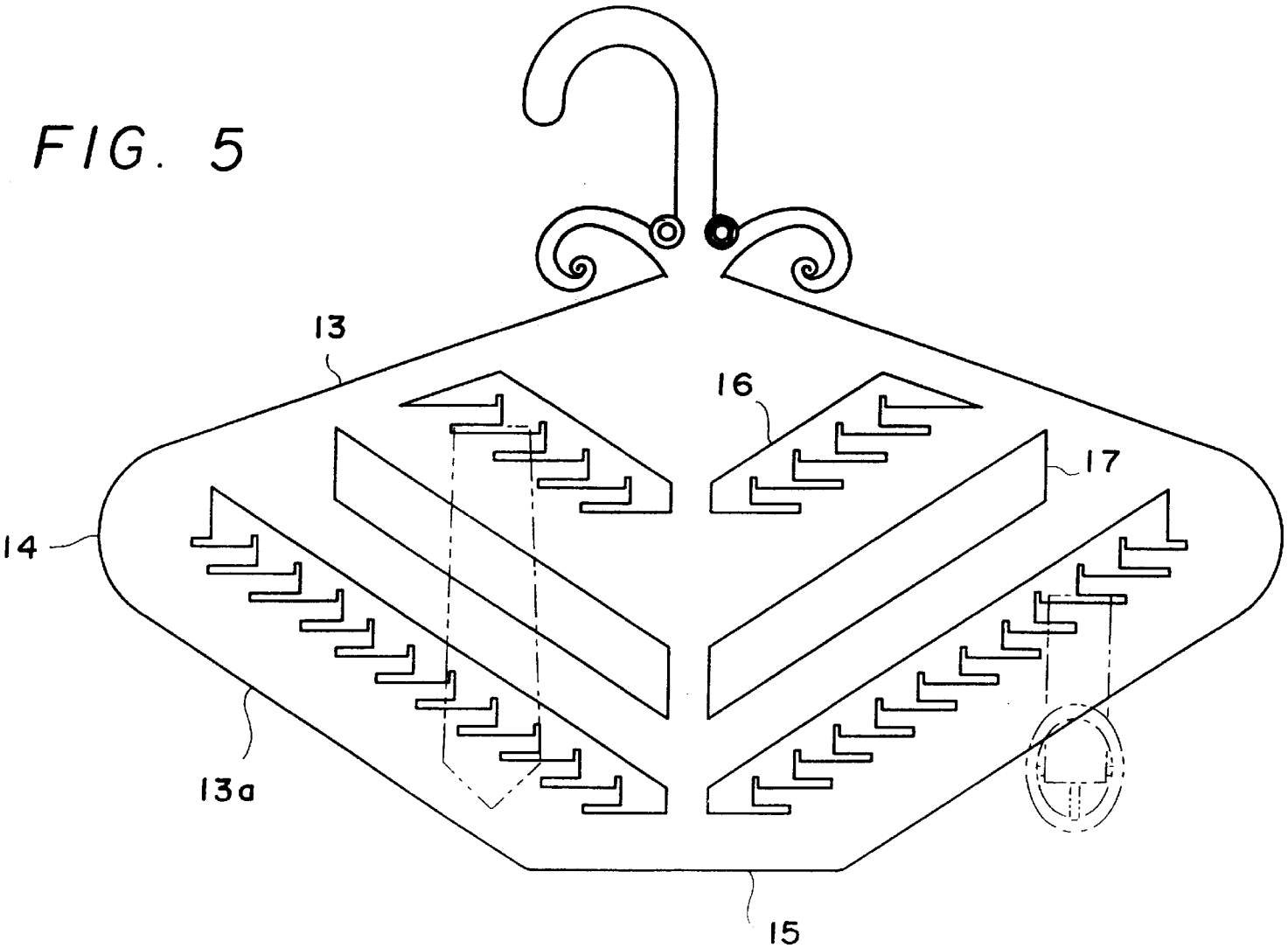
FIG. 5 is a front elevation of an alternate embodiment of the invention.

FIG. 5 shows an alternative shaped structure design having the same integrated hook and curved surfaces and steps. The steps are, however, oriented differently, and the shaped member is altered so as to resemble a baseball diamond. Starting from the top at the juncture of the hook, divergent sides 13 are joined to lower convergent sides 13*a* by a curved section 14. The convergent sides terminate in a horizontal base 15. The set of cutouts and steps 16 form an acute angle with the divergent sides if extended, and converge toward each other. The intermediate cutouts 17 have the same orientation as the steps. Additionally, while there is a second row of steps below and parallel to the first row there are a smaller number of steps at the top level.

While the devices described herein constitute the preferred embodiments, it should be understood various modifications, alterations and changes could be made that would be obvious to those skilled in the art without departing from the scope of the invention as defined by the appended claims.

I claim:

1. A rack for supporting apparel accessories such as ties, belts and scarfs comprises a flat plate of injection molded plastic made in the form of a shaped figure with divergent, downwardly inclined sides, that join lower sides, said figure having cutouts configured to form sets of steps, said steps having horizontal legs and shorter vertical legs, each set of steps being spaced from said inclined, divergent sides and being aligned symmetrically with each other, with a second set of steps spaced below a first set and being parallel thereto, a pair of elongate cutouts intermediate said sets of steps and being arranged parallel to said sets of steps, a hook shaped member projecting upwardly intermediate said downwardly inclined sides and integral therewith, a pair of curved members extending outwardly from said hook member, each curved member being adjacent said inclined, divergent sides, said curved members ending in spirals, and a pair of ringlets located between an origin of the hook member and the curved member.

2. A rack member as in claim 1 wherein fasteners are inserted through said ringlets and fixed in a closet structure to secure said rack.

3. A rack as in claim 1 wherein said horizontal legs of said first set and said second set of steps project inwardly toward each other.

4. A rack as in claim 2 wherein said first set and said second set of steps comprise an equal number of steps.

5. A rack as in claim 1 wherein said shorter legs of said steps serve as backups to prevent said apparel accessories from falling off said rack.

6. A rack as in claim 1 wherein said plastic is a thermosetting plastic.

7. A rack as in claim 1 wherein said shaped figure is coated with a fluorescent paint.

8. A rack for supporting apparel accessories in the shape of an extended coat hanger having downwardly inclined intersecting vertical sides, said vertical sides joining a horizontal base, sets of cutouts configured to form a plurality of downwardly, inclined, divergent sets of steps, said sets of steps being arranged in rows that are aligned with each other, said steps having horizontal legs that extend toward each other, a first set of steps forming an acute angle with respect to said divergent sides, a second set of steps being spaced from said first set and parallel thereto, a pair of cutouts intermediate said sets of steps, a hook member located above and between the juncture of said divergent sides and a pair of arcuate members extending outwardly from said hook and adjacent said divergent sides.

9. A rack for supporting apparel accessories somewhat in the shape of a baseball diamond having downwardly inclined divergent sides joined by arcuate sections to downwardly inclined convergent sides intersecting a horizontal base, sets of cutouts configured to form a plurality of downwardly convergent steps, each set of steps being as aligned mirror images of one another, said sets of steps forming acute angles with respect to said downwardly inclined divergent sides, said sets of steps having horizontal legs that extend away from each other, said sets of steps being spaced from each other, a pair of intermediate, elongate cutouts between said sets, a hook member located above and between the juncture of said divergent sides, and a pair of arcuate members extending away from said hook and adjacent said divergent sides.

* * * * *